US009212594B2

(12) United States Patent
An et al.

(10) Patent No.: US 9,212,594 B2
(45) Date of Patent: Dec. 15, 2015

(54) STRUCTURE OF EXHAUST SYSTEM FOR CDA ENGINE

(71) Applicant: Hyundai Motor Company, Seoul (KR)

(72) Inventors: Ho-Chan An, Whasung-Si (KR); Chul-Min Park, Whasung-Si (KR); Seung-Hwan Lim, Whasung-Si (KR); Jong-Ho Seon, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/497,999

(22) Filed: Sep. 26, 2014

(65) Prior Publication Data

US 2015/0101884 A1 Apr. 16, 2015

(30) Foreign Application Priority Data

Oct. 15, 2013 (KR) ..... 10-2013-122374

(51) Int. Cl.
*F01N 13/02* (2010.01)
*F01N 13/08* (2010.01)

(52) U.S. Cl.
CPC ..... *F01N 13/08* (2013.01); *F01N 13/02* (2013.01); *F01N 13/087* (2013.01); *F01N 2240/36* (2013.01)

(58) Field of Classification Search
CPC .... F01N 13/087; F01N 13/02; F01N 2240/36
USPC ..... 181/232, 253, 254
See application file for complete search history.

(56) References Cited

U.S. PATENT DOCUMENTS 4,971,166 A * 11/1990 Hase ..... 181/254

FOREIGN PATENT DOCUMENTS

JP 2689720 B2 8/1997
KR 10-2006-0069641 A 6/2006

* cited by examiner

*Primary Examiner* — Jeremy Luks
(74) *Attorney, Agent, or Firm* — Morgan, Lewis & Bockius LLP

(57) ABSTRACT

A structure of an exhaust system for a CDA engine may include three baffles coupled in a main muffler in a lateral direction, and dividing an interior of the main muffler into a first space, a second space, a third space, and a fourth space, a first connecting pipe disposed outside the main muffler, connecting the second space and the third space and having a passage in which exhaust gas flows, a second connecting pipe disposed outside the main muffler, connecting the second space and the third space, and having a passage in which the exhaust gas flows, a first valve coupled to the passage of the first connecting pipe, and a second valve coupled to the passage of the second connecting pipe.

10 Claims, 6 Drawing Sheets

STRUCTURE OF EXHAUST SYSTEM FOR CDA ENGINE

CROSS-REFERENCE TO RELATED APPLICATIONS

The present application claims priority to Korean Patent Application No. 10-2013-122374, filed Oct. 15, 2013, the entire contents of which is incorporated herein for all purposes by this reference.

BACKGROUND OF THE INVENTION

1. Field of the Invention

The present invention relates to a structure of an exhaust system for a vehicle, and more particularly, to a structure of an exhaust system for a cylinder deactivation (CDA) engine, in which a main muffler is divided into four spaces by three baffles, and a first connecting pipe and a second connecting pipe which connect a second space and a third space, a first valve which is coupled to a passage of the first connecting pipe, and a second valve which is coupled to a passage of the second connecting pipe are provided, thereby reducing noise in the exhaust system with maximum efficiency in accordance with characteristics of an engine.

2. Description of Related Art

Recently, in respect to increased concerns about the environment, major issues such as an environmental problem with excessive emission of exhaust gas of a vehicle and consumers preferring a high efficiency vehicle because of an increase in cost of crude oil have become the focus.

Therefore, various technologies are being developed in order to improve fuel efficiency of a vehicle, and increase output of an engine.

For example, a variable induction system (VIS) which changes a length or a cross-sectional area of an intake manifold in accordance with air intake resistance that is varied depending on a rotational region of an engine, a variable valve timing (VVT) which adjusts an opening timing and an opening degree of a valve depending on a rotational region of an engine, a variable valve lift (VVL) which adjusts a lifting height of a valve, and a cylinder deactivation (CDA) which switches some cylinders in an engine to a non-operational state or a full operational state in accordance with a traveling state in order to improve fuel efficiency have been developed and used.

Among the aforementioned technologies, the CDA engine refers to an engine that deactivates some of the cylinders when braking the vehicle or when the vehicle travels at a constant speed, and fuel supply and operations of intake/exhaust valves are stopped at the deactivated cylinder side.

Because maximum output of the engine of the vehicle is required only when the vehicle accelerates or travels up a slope, fuel consumption may be reduced by not selectively igniting fuel in the cylinder in a case in which the vehicle may be operated by merely using partial output of the engine.

For example, in the case of the vehicle in which a four-cylinder engine is mounted, because there is no reason to operate all of the cylinders to generate power when braking the vehicle in a traveling state, or when the vehicle is in a low idle condition or a low load condition, two cylinders are deactivated, and power is generated only by the remaining two cylinders.

However, the CDA engine has advantages in that fuel consumption is low and fuel efficiency is high in comparison with a typical engine, but has problems in that because fuel in some of the cylinders is not ignited, the main component of engine noise is changed and low frequency noise is increased.

In order to solve the aforementioned problems, in a structure of an exhaust system for a CDA engine in the related art, as illustrated in FIG. 1, an additional muffler 2 is mounted in an exhaust pipe 4, which connects a sub muffler 1 and a main muffler 3, so that the entire exhaust pipe 4 is divided into several segments, thereby reducing noise.

That is, in the CDA mode in which only two cylinders of the four-cylinder engine are operated, a half order low frequency noise component (a noise component that corresponds to C1, C3, and the like among main components of engine noise), which is hardly generated in a general mode, is additionally generated, and combined with a low frequency resonance mode in the existing exhaust pipe, and as a result, there is a problem in that noise characteristics of the vehicle deteriorates.

Therefore, as illustrated in FIG. 2, the additional muffler 2 is mounted at peak points of a second resonance mode of the exhaust system and a fourth resonance mode of the exhaust system so as to reduce a resonance mode of the exhaust system.

However, in the case of the structure of the exhaust system for a CDA engine in the related art in which a separate additional muffler is mounted, there are still problems in that spaces for other components (a fuel tank, a rear suspension, an interior space, and the like) need to be decreased in order to mount the additional muffler between the sub muffler and the main muffler, and a weight of the vehicle is excessively increased because of the additional muffler.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a structure of an exhaust system for a CDA engine, in which a main muffler is divided into four spaces, and connecting pipes and valves, which connect the respective spaces, are provided, thereby solving a problem with resonance in an exhaust pipe due to an application of a CDA mode without mounting a separate additional muffler.

According to various aspects of the present invention, a structure of an exhaust system for a cylinder deactivation (CDA) engine, having a first exhaust pipe which is connected to a sub muffler connected to an exhaust pipe of a vehicle, and through which exhaust gas passes, a main muffler which is connected to the first exhaust pipe, and reduces noise generated by the exhaust gas, and a second exhaust pipe which is connected to the main muffler, and through which the exhaust gas passing through the main muffler passes, may include three baffles coupled in the main muffler in a lateral direction, and dividing an interior of the main muffler into a first space, a second space, a third space, and a fourth space, a first connecting pipe disposed outside of the main muffler, the first connecting pipe connecting the second space and the third space of the main muffler, and having a passage in which the exhaust gas flows, a second connecting pipe disposed outside the main muffler, the second connecting pipe connecting the second space and the third space of the main muffler, having a passage in which the exhaust gas flows, and being formed to be relatively shorter than the first connecting pipe, a first valve coupled to the passage of the first connecting pipe and opening and closing the passage of the first connecting pipe; and a second valve coupled to the passage of the second connecting pipe an opening and closing the passage of the second connecting pipe, in which one of the three baffles, coupled between the first space and the second space, and another of the three baffles, coupled between the third space and the fourth space, each have an aperture or a plurality of holes for the exhaust gas to flow through.

The structure of the exhaust system for a CDA engine may further include a link unit connecting the first valve and the second valve, in which the first valve and the second valve are coupled to the link unit while having a phase difference of 90°, the second valve is closed when the first valve is opened, and the second valve is opened when the first valve is closed.

The three baffles may include a first baffle disposed between the first space and the second space, a second baffle disposed between the second space and the third space, and a third baffle disposed between the third space and the fourth space, in which one end of the first connecting pipe may extend from the second space to the first space through the first baffle, and may be bent and protrude to the outside of the main muffler, and another end of the first connecting pipe may extend through the third baffle from the third space to the fourth space, and may be bent and protrude to the outside of the main muffler.

The first exhaust pipe may extend into the first space by passing through the third baffle, the second baffle and the first baffle sequentially.

An end of the second exhaust pipe may extend into the fourth space by passing through the first baffle, the second baffle and the third baffle sequentially.

A plurality of holes is formed to the first baffle and the third baffle.

The first valve may be an active valve that is operated by a motor.

When the engine of the vehicle is in a general mode, the second valve may be opened, and the first valve may be closed, such that the exhaust gas in the main muffler flows only through the second connecting pipe, and when the engine of the vehicle is in a CDA mode, the first valve may be opened, and the second valve may be closed, such that the exhaust gas in the main muffler flows only through the first connecting pipe.

The present invention having the aforementioned configuration includes the three baffles which are coupled in the main muffler in a lateral direction, the first connecting pipe and the second connecting pipe which connect the second space and the third space, the first valve which is coupled to the passage of the first connecting pipe, and the second valve which is coupled to the passage of the second connecting pipe, thereby solving a problem with resonance in an exhaust pipe due to an application of a CDA mode while maintaining a structure of the existing exhaust system.

That is, when the engine of the vehicle is in the CDA mode, the first valve is opened, and the second valve is closed, such that the exhaust gas in the main muffler flows only through the first connecting pipe, and as a result, positions of the first muffler and the second muffler are far away from each other, thereby increasing a length of the entire exhaust system, and achieving the effect that is obtained when another muffler is further added.

When the engine of the vehicle is in a general mode, the second valve is opened, and the first valve is closed, such that the exhaust gas in the main muffler flows only through the second connecting pipe, thereby reducing overall back pressure by shortening a flow path of the exhaust gas.

The structure further includes a link unit which connects the first valve and the second valve, in which the second valve is closed when the first valve is opened, and the second valve is opened when the first valve is closed, such that even when only one valve is operated, the other valve may also be organically operated.

By actively utilizing a structure of the existing exhaust system, it is possible to minimize a decrease in space for the other components (a fuel tank, a rear suspension, an interior space, and the like) and an increase in weight of the vehicle, which are caused by mounting an additional muffler.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
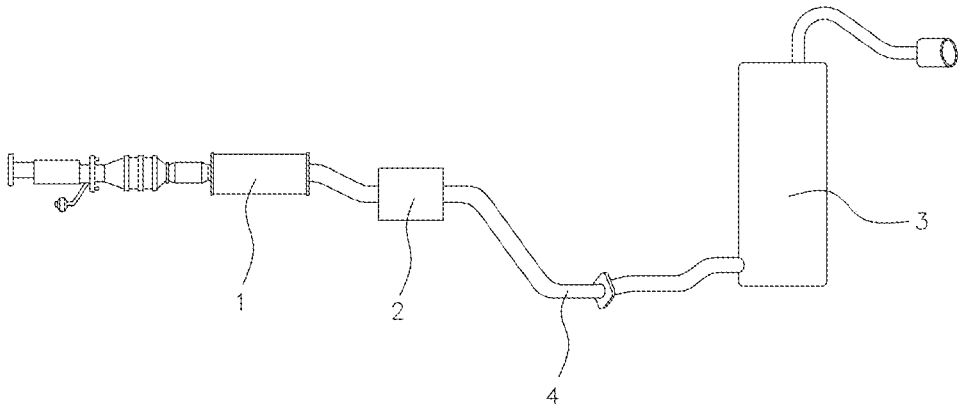
FIG. 1 (Related Art)
FIG. 1 is a top plan view illustrating an appearance in which an additional muffler is mounted in a structure of an exhaust system for a CDA engine in the related art.
Figure 2:
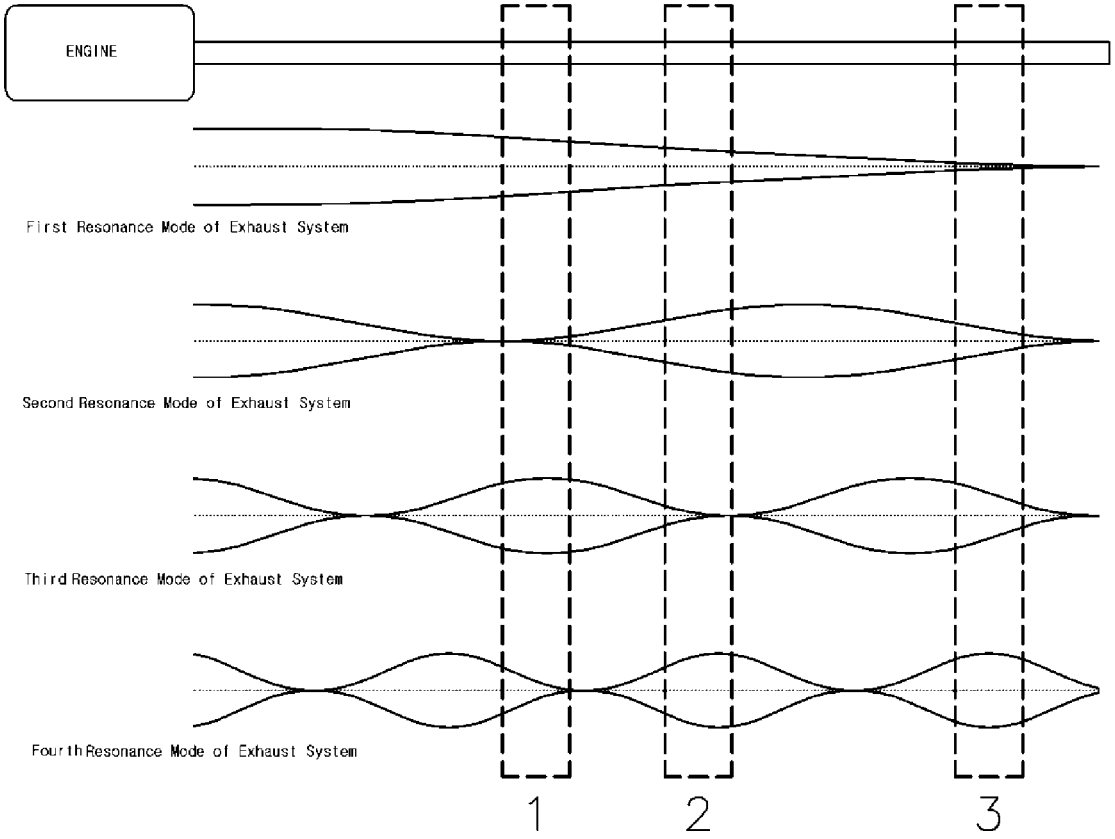
FIG. 2 (Related Art)
FIG. 2 is an exemplified view schematically illustrating resonance modes of the exhaust system and positions of the muffler in the structure of the exhaust system for a CDA engine in the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A structure of an exhaust system for a cylinder deactivation (CDA) engine according to the present invention having a first exhaust pipe 12 which is connected to a sub muffler 10 connected to an exhaust pipe of a vehicle, and through which exhaust gas passes, a main muffler 20 which is connected to the first exhaust pipe 12, and reduces noise generated by the exhaust gas, and a second exhaust pipe 14 which is connected to the main muffler 20, and through which the exhaust gas passing through the main muffler 20 passes, may include a baffle 30 which includes three baffles 32, 34 and 36 which are coupled in the main muffler 20 in a lateral direction, and divide the interior of the main muffler 20 into a first space 22, a second space 24, a third space 26 and a fourth space 28, a first connecting pipe 40 which is disposed outside the main muffler 20, connects the first space 22 and the fourth space 28 of the main muffler 20, and has a passage in which the exhaust gas flows, a second connecting pipe 50 which is disposed outside the main muffler 20, connects the second space 24 and the third space 26 of the main muffler 20, has a passage in which the exhaust gas flows, and is formed to be relatively shorter than the first connecting pipe 40, a first valve 42 which is coupled to the passage of the first connecting pipe 40 so as to open and close the passage of the first connecting pipe 40, and a second valve 52 which is coupled to the passage of the second connecting pipe 50 so as to open and close the passage of the second connecting pipe 50, in which the baffle 32, which is coupled between the first space 22 and the second space 24, and the baffle 36, which is coupled between the third space 26 and the fourth space 28, have an aperture or a plurality of holes so that the exhaust gas may flow therethrough.

Figure 3:
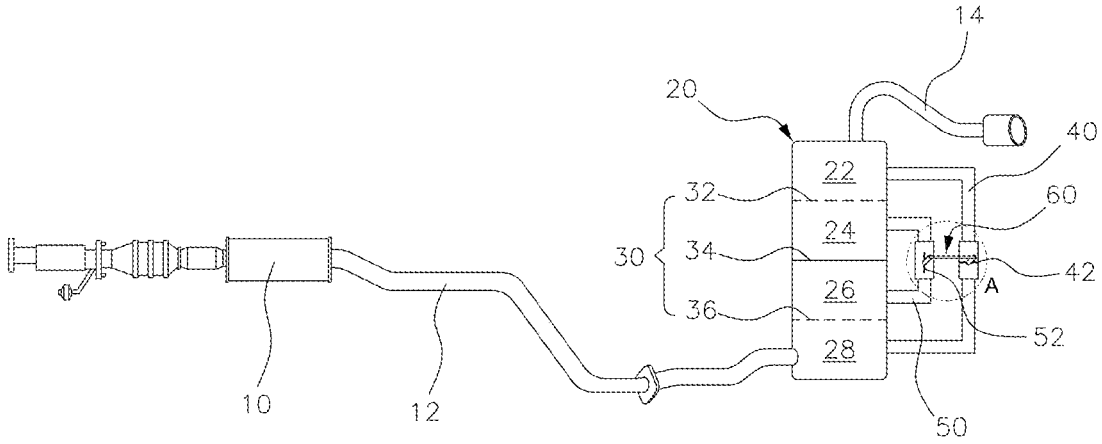
FIG. 3 is a top plan view illustrating an appearance of an exemplary structure of an exhaust system for a CDA engine according to the present invention.

As illustrated in FIG. 3, the sub muffler 10 is connected to an exhaust pipe (not illustrated) of the vehicle, and serves to primarily reduce noise generated by the exhaust gas discharged from the exhaust pipe.

The first exhaust pipe 12 is connected to a rear side of the sub muffler 10 so as to supply the exhaust gas to the main muffler 20, and noise generated by the exhaust gas is secondarily reduced by the main muffler 20 connected to the first exhaust pipe 12.

The second exhaust pipe 14 is connected to a rear side of the main muffler 20, and the second exhaust pipe 14 serves to discharge the exhaust gas discharged from the main muffler 20 to the outside of the vehicle.

Figure 6:
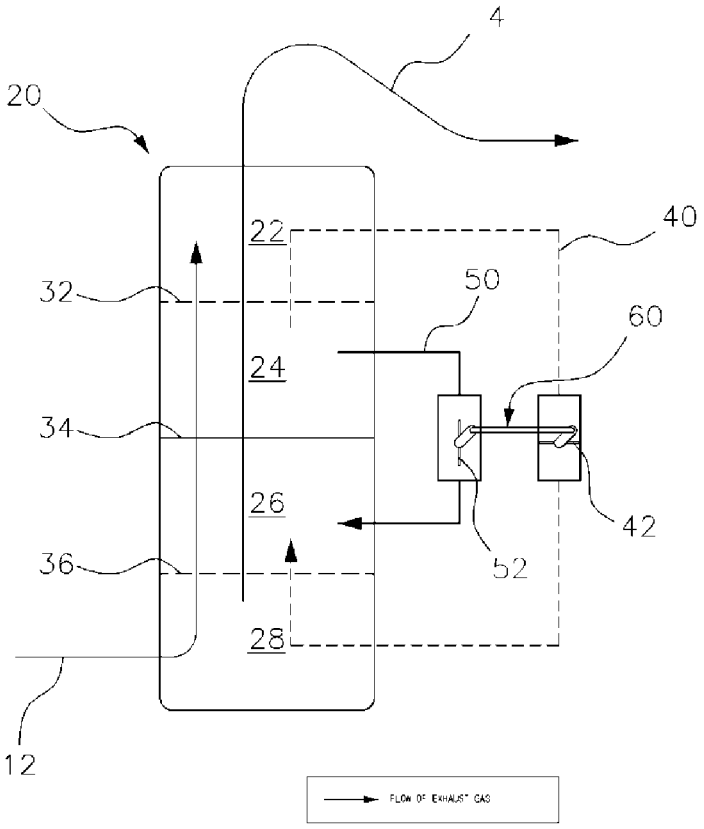
FIG. 6 is an exemplified view illustrating a case in which an engine of a vehicle is in a general mode in the exemplary structure of the exhaust system for the CDA engine according to the present invention.

As illustrated in FIG. 6, the first exhaust pipe 12 is extended from the sub muffler 10 to the first space 22 of the main muffler 20, which will be described below, and allows the exhaust gas passing through the sub muffler 10 to be supplied to the first space 22 of the main muffler 20.

In addition, the second exhaust pipe 14 is extended from the fourth space 28 of the main muffler 20, which will be described below, to the outside of the vehicle, and allows the exhaust gas passing through the interior of the main muffler 20 to be discharged to the outside of the vehicle.

As illustrated in FIG. 3, the three baffles 32, 34 and 36 are coupled in the main muffler 20 in the lateral direction so as to divide the interior of the main muffler 20 into the first space 22, the second space 24, the third space 26 and the fourth space 28, and in the illustrated exemplary embodiment, the space, which is positioned at an uppermost end, is the first space 22, the space, which is positioned immediately below the first space 22, is the second space 24, the space, which is positioned immediately below the second space 24, is the third space 26, and the space, which is positioned at a lowermost end, is the fourth space 28.

In the illustrated exemplary embodiment, the baffle 30 includes a first baffle 32 that is disposed between the first space 22 and the second space 24, a second baffle 34 that is disposed between the second space 24 and the third space 26, and a third baffle 36 that is disposed between the third space 26 and the fourth space 28.

The first baffle 32 and the third baffle 36 have an aperture or a plurality holes so that the exhaust gas may freely flow therethrough, and the second baffle 34 is formed in a blocked plate shape, which has no aperture or hole, so that the exhaust gas flows only through the first connecting pipe 40 or the second connecting pipe 50 that will be described below.

In the illustrated embodiment, the first baffle 32 and the third baffle 36 have the aperture or the plurality of holes so that the exhaust gas flows therethrough, but the first baffle 32 and the third baffle 36 may include other structures such as a plurality of short pipes and a permeable membrane that may allow the exhaust gas to flow therethrough.

As illustrated in FIG. 3, the first connecting pipe 40 and the second connecting pipe 50 are coupled outside the main muffler 20, and specifically, the first connecting pipe 40 and the second connecting pipe 50 connect the second space 24 and the third space 26 of the main muffler 20.

As illustrated in FIG. 6, the first connecting pipe 40 is formed as a long pipe having an overall C-shape which has an inlet and an outlet that are curved in directions toward the second space 24 and the third space 26, respectively, and the second connecting pipe 50 is formed as a C-shaped pipe, and a length of the second connecting pipe 50 is relatively shorter than that of the first connecting pipe 40.

That is, one end of the first connecting pipe 40 is extended from the second space 24 to the first space 22 through the first baffle 32, and then bent and protrudes to the outside of the main muffler 20, the other end of the first connecting pipe 40 is extended from the third space 26 to the fourth space 28 through the third baffle 36, and then bent and protrudes to the outside of the main muffler 20, and the second connecting pipe 50 protrudes directly from the second space 24 to the outside of the main muffler 20, and is connected to the third space 26.

The first connecting pipe 40 and the second connecting pipe 50 may be formed in various shapes such as a 'U' shape depending on a shape of the main muffler 20, utilization of an overall space in the exhaust system, and the type of vehicle.

Figure 4:
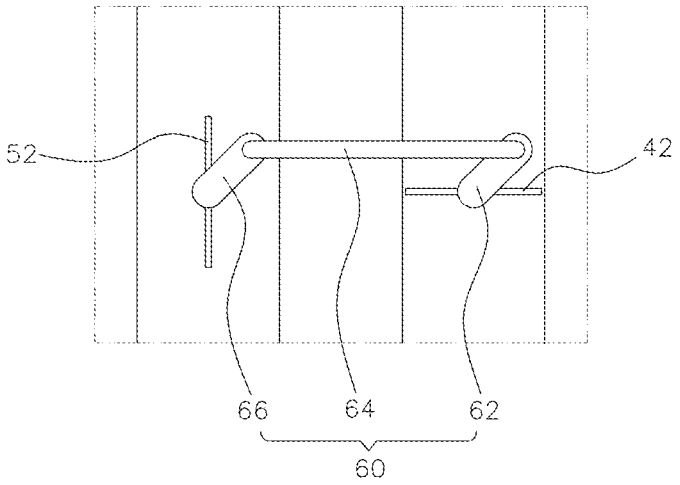
FIG. 4 is an enlarged view of part A of FIG. 3 according to the present invention.

As illustrated in FIGS. 3 and 4, the first valve 42 and the second valve 52 are installed in the passages of the first connecting pipe 40 and the second connecting pipe 50, respectively, and shut off and permit the flow of the exhaust gas that flows through the first connecting pipe 40 and the second connecting pipe 50.

As illustrated in FIG. 4, the first valve 42 and the second valve 52 have general valve covers formed in a circular plate, and open or close the first connecting pipe 40 and the second connecting pipe 50 by being controlled by a control unit depending on whether the CDA engine is operated.

The illustrated exemplary embodiment shows a case in which the CDA mode is not operated (that is, operated in a general mode), and shows a state in which the first valve 42 is laterally disposed to close the first connecting pipe 40, and the second valve 52 is longitudinally disposed to open the second connecting pipe 50 such that the exhaust gas in the main muffler flows only through the second connecting pipe.

As illustrated in FIG. 4, the first valve 42 and the second valve 52 are connected by a link unit 60.

In the illustrated embodiment, the link unit 60 includes a first link 62 which has one end coupled to the first valve 42, and is moved depending on an opening and closing operation of the first valve 42, a link arm 64 which has one end that is pivotally coupled to the other end of the first link 62; and a second link 66 which has one end that is pivotally coupled to the other end of the link arm 64, and the other end that is coupled to the second valve 52.

As illustrated in FIG. 4, the first valve 42 and the second valve 52 may be coupled to the link unit 60 while having a phase difference by 90°, and the first link 62 and the second link 66 may be disposed in parallel with each other.

As illustrated in FIG. 6, when the first valve 42 is laterally disposed, the first link 62 and the second link 66 are generally inclined to the right, and the second valve 52 and the first valve 42 are longitudinally disposed while having a phase difference by 90°.

Figure 8:
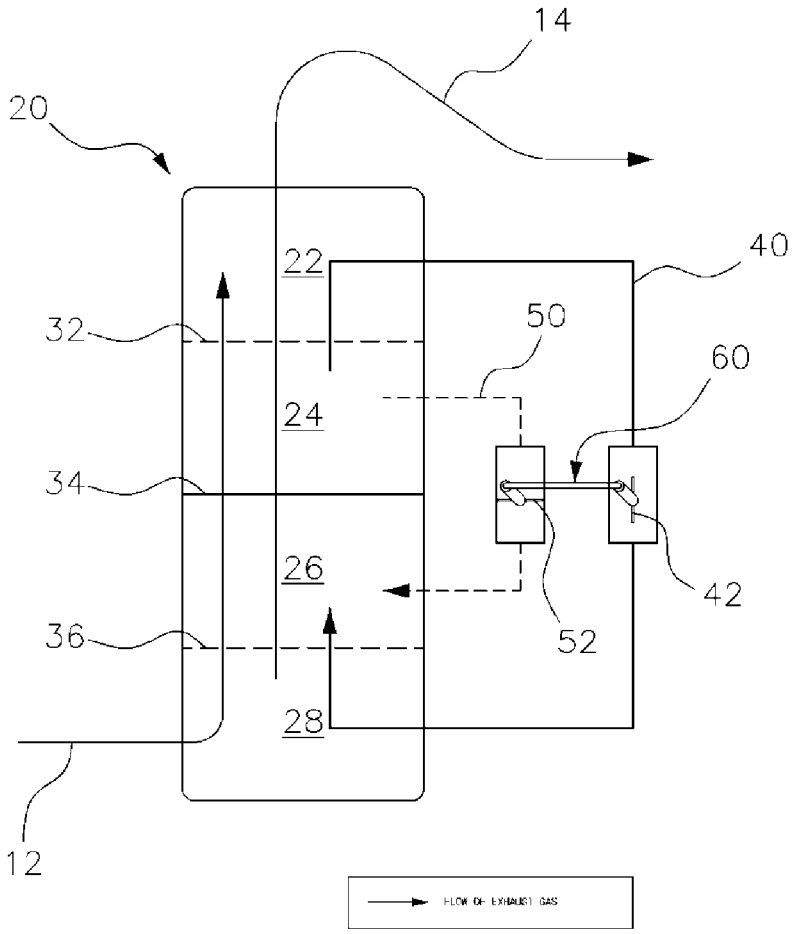
FIG. 8 is an exemplified view illustrating a case in which the engine of the vehicle is in a CDA mode in the exemplary structure of the exhaust system for the CDA engine according to the present invention.

As illustrated in FIG. 8, when the first valve 42 is longitudinally moved, the first link 62 is moved to the left, the second link 66, which is connected to the link arm 64, is also moved to the left along with the movement of the first link 62, and the second valve 52 is moved by 90° and laterally disposed.

Figure 5:
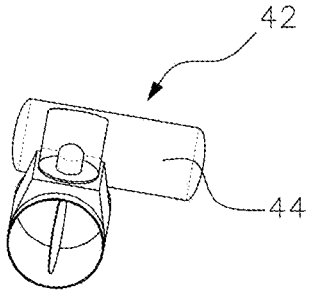
FIG. 5 is a perspective view illustrating an active valve that is applied as a first valve in the exemplary structure of the exhaust system for the CDA engine according to the present invention.

As illustrated in FIG. 5, the first valve 42 may be an active valve that is operated by a motor 44, and the second valve 52 may be a manual valve that is operated along with the movement of the first valve 42.

That is, when the first valve 42 is operated by the motor 44 and opens or closes the first connecting pipe 40, the second valve 52, which is connected with the first valve 42 through the link unit 60, closes or opens the second connecting pipe 50 while corresponding to the movement of the first valve 42.

An operational process and an operational effect of the exemplary structure of the exhaust system for the CDA engine according to the present invention will be described below.

As illustrated in FIG. 6, when the CDA mode is not operated, that is, when the engine of the vehicle is in the general mode, the exhaust gas is first supplied to the first space 22 in the main muffler 20 through the first exhaust pipe 12.

Next, the exhaust gas supplied to the first space 22 flows to the second space 24 through the aperture or the plurality of holes formed in the first baffle 32, and flows to the third space 26 through the opened second connecting pipe 50.

The exhaust gas flowing to the third space 26 flows to the fourth space 28 through the aperture or the plurality of holes of the third baffle 36, and is discharged to the outside of the main muffler 20 through the second exhaust pipe 14 connected to the fourth space 28.

In addition, when the engine of the vehicle is in the general mode, only a main order component (a noise component that corresponds to C2, C4, and the like among main components of engine noise) of engine noise is mainly generated, and as a result, the possibility that the main order component is combined with low frequency resonance mode of the exhaust pipe is relatively low.

Figure 7A:
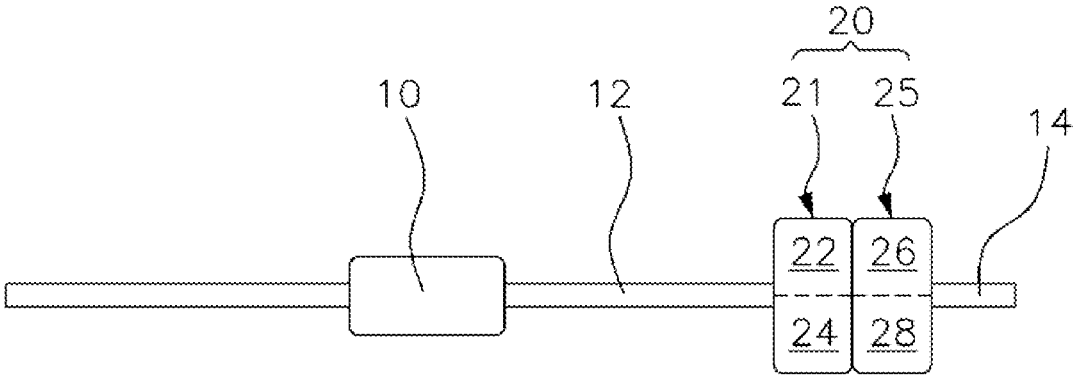
FIGS. 7A and 7B are exemplified views schematically illustrating resonance modes of the exhaust system and positions of a muffler in the case in which the engine of the vehicle is in a general mode in the exemplary structure of the exhaust system for the CDA engine according to the present invention.
Figure 7B:
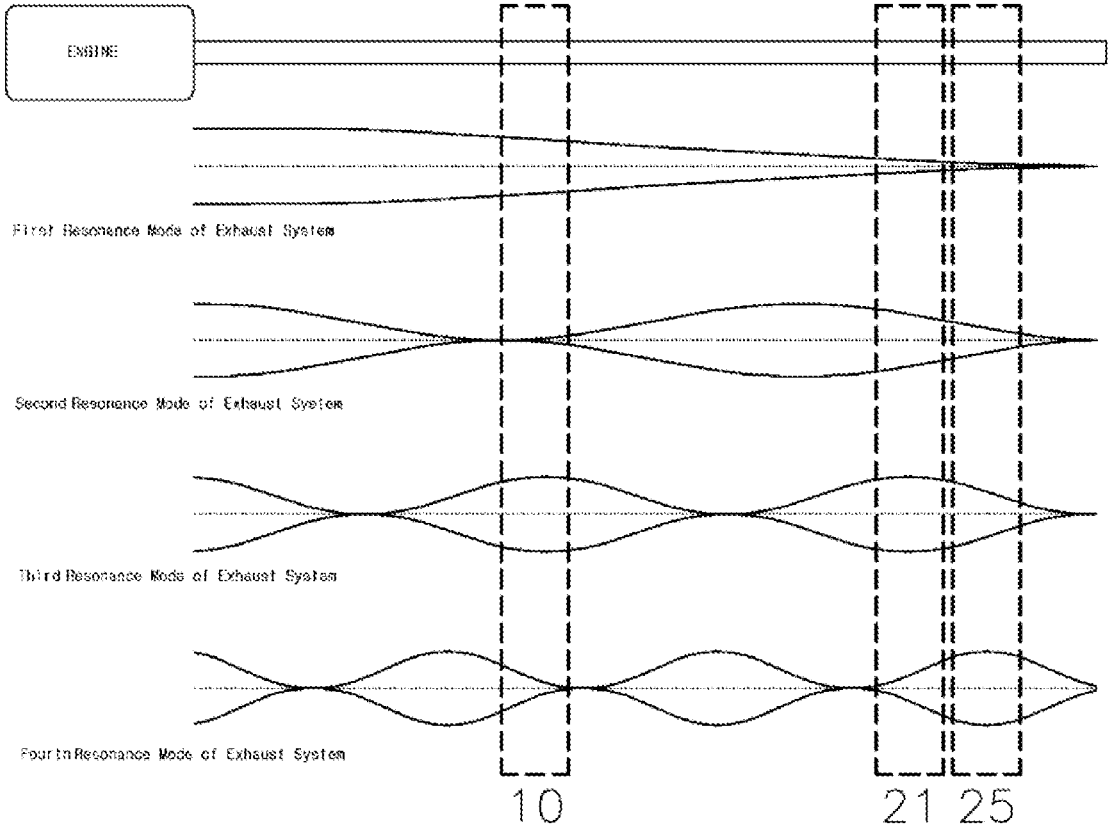

Therefore, as illustrated in FIGS. 7A and 7B, when the engine of the vehicle is in the general mode, a first muffler 21 including the first space 22 and the second space 24 of the main muffler 20 is disposed to be adjacent to a second muffler 25 including the third space 26 and the fourth space 28 of the main muffler 20, and serves to reduce back pressure throughout the entire exhaust system.

That is, when the engine of the vehicle is in the general mode, only the second connecting pipe 50, which is a relatively short flow path, is opened, the first muffler 21 is disposed to be adjacent to the second muffler 25, and as a result, an effect of reducing back pressure throughout the exhaust system is produced.

As illustrated in FIG. 8, likewise, even when the CDA mode is operated, the exhaust gas is first supplied to the first space 22 in the main muffler 20 through the first exhaust pipe 12, and flows to the second space 24 through the aperture or the plurality of holes of the first baffle 32.

Next, the exhaust gas flowing to the second space 24 flows to the third space 26 through the first connecting pipe 40, flows to the fourth space 28 through the aperture or the plurality of holes of the third baffle 36, and is discharged to the outside of the main muffler 20 through the second exhaust pipe 14 connected to the fourth space 28.

In addition, when the engine of the vehicle is in the CDA mode, a half order component (a noise component that corresponds to C1, C3, and the like among main components of the engine noise) of the engine noise is additionally generated, and combined with the low frequency resonance mode of the exhaust pipe, which causes noise characteristics of a vehicle to deteriorate.

Figure 9A:
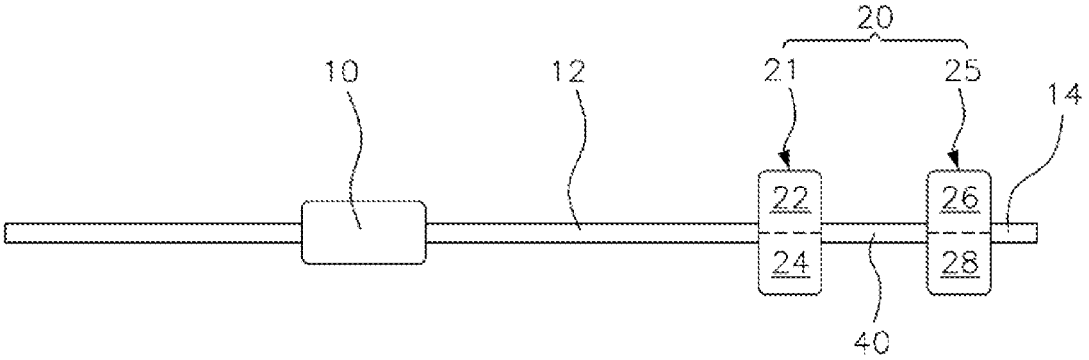
FIGS. 9A and 9B are exemplified views schematically illustrating resonance modes of the exhaust system and positions of the muffler in the case in which the engine of the vehicle is in the CDA mode in the exemplary structure of the exhaust system for the CDA engine according to the present invention.
Figure 9B:
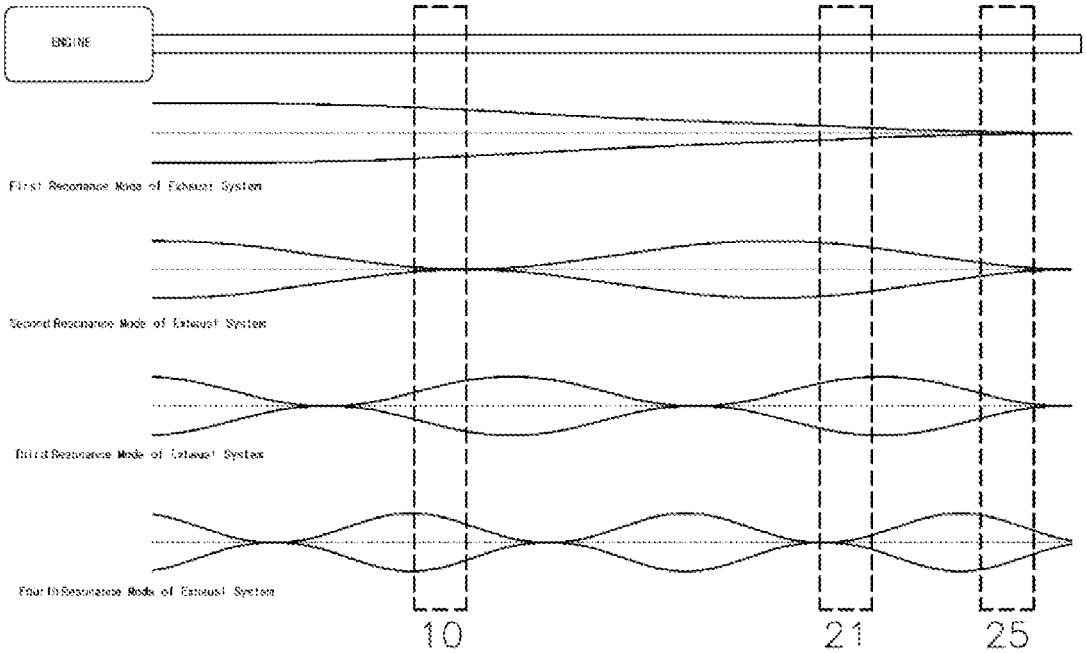

Therefore, as illustrated in FIGS. 9A and 9B, when the engine of the vehicle is in the CDA mode, the main muffler 20 is separated into the first muffler 21 and the second muffler 25 by the first connecting pipe 40, and the first muffler 21 is disposed to be adjacent to a peak point of a second resonance mode of the exhaust system, thereby reducing resonance in the exhaust pipe.

As a distance between the first muffler 21 and the second muffler 25 becomes longer, a length of the structure of the entire exhaust system becomes longer, and the sub muffler 10 becomes relatively closer to a peak point of a first resonance mode of the exhaust system.

That is, when the engine of the vehicle is in the CDA mode, only the first connecting pipe 40, which is a relatively long flow path, is opened by the first valve, the second valve is closed, such that the exhaust gas in the main muffler flows only through the first connecting pipe, and the first muffler 21 and the second muffler 25 are separated, thereby achieving the effect that is obtained when another muffler is further added.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of an exhaust system for a cylinder deactivation (CDA) engine, which includes a first exhaust pipe which is connected to a sub muffler connected to an exhaust pipe of a vehicle, and through which exhaust gas passes, a main muffler which is connected to the first exhaust pipe, and reduces noise generated by the exhaust gas, and a second exhaust pipe which is connected to the main muffler, and through which the exhaust gas passing through the main muffler passes, the structure comprising:

three baffles coupled in the main muffler in a lateral direction, and dividing an interior of the main muffler into a first space, a second space, a third space and a fourth space;

a first connecting pipe disposed outside of the main muffler, the first connecting pipe connecting the second space and the third space of the main muffler, and having a passage in which the exhaust gas flows;

a second connecting pipe disposed outside the main muffler, the second connecting pipe connecting the second space and the third space of the main muffler, having a passage in which the exhaust gas flows, and being formed to be relatively shorter than the first connecting pipe;

a first valve coupled to the passage of the first connecting pipe and opening and closing the passage of the first connecting pipe; and a second valve coupled to the passage of the second connecting pipe and opening and closing the passage of the second connecting pipe, wherein one of the three baffles, coupled between the first space and the second space, and another of the three baffles, which is coupled between the third space and the fourth space, each have an aperture or a plurality of holes for the exhaust gas to flow through.

2. The structure of claim 1, further comprising:

a link unit connecting the first valve and the second valve, wherein the first valve and the second valve are coupled to the link unit while having a phase difference of 90°, wherein the second valve is closed when the first valve is opened, and wherein the second valve is opened when the first valve is closed.

3. The structure of claim 1, wherein the three baffles include:

a first baffle disposed between the first space and the second space;

a second baffle disposed between the second space and the third space; and a third baffle disposed between the third space and the fourth space, wherein one end of the first connecting pipe extends from the second space to the first space through the first baffle, and is bent and protrudes to the outside of the main muffler, and wherein another end of the first connecting pipe extends through the third baffle from the third space to the fourth space, and is bent and protrudes to the outside of the main muffler.

4. The structure of claim 3, wherein the first exhaust pipe extends into the first space by passing through the third baffle, the second baffle and the first baffle sequentially.

5. The structure of claim 3, wherein an end of the second exhaust pipe extends into the fourth space by passing through the first baffle, the second baffle and the third baffle sequentially.

6. The structure of claim 3, wherein a plurality of holes are formed to the first baffle and the third baffle.

7. The structure of claim 1, wherein the first valve is an active valve operated by a motor.

8. The structure of claim 2, wherein the first valve is an active valve operated by a motor.

9. The structure of claim 2, wherein when the engine of the vehicle is in a general mode, the second valve is opened, and the first valve is closed, such that the exhaust gas in the main muffler flows through the second connecting pipe.

10. The structure of claim 2, wherein when the engine of the vehicle is in a CDA mode, the first valve is opened, and the second valve is closed, such that the exhaust gas in the main muffler flows through the first connecting pipe.

* * * * *